United States Patent [19]

Hudelmaier

[11] Patent Number: 4,490,045

[45] Date of Patent: Dec. 25, 1984

[54] CONCRETE MIXER

[75] Inventor: Gerhard Hudelmaier, Ulm, Fed. Rep. of Germany

[73] Assignee: Ingrid Hudelmaier, Ulm, Fed. Rep. of Germany

[21] Appl. No.: 340,711

[22] Filed: Jan. 19, 1982

[30] Foreign Application Priority Data

Jan. 19, 1981 [DE] Fed. Rep. of Germany ..... 3101468

[51] Int. Cl.[3] ..... B28C 5/24

[52] U.S. Cl. ..... 366/56; 366/118

[58] Field of Search ..... 366/31, 54, 55, 56, 366/57, 60, 61, 63, 108, 113, 114, 116, 117, 118, 170, 216, 220, 222, 238, 600; 222/196; 241/175, 176, 178

[56] References Cited

U.S. PATENT DOCUMENTS

| | | | |
|---|---|---|---|
| 399,739 | 3/1889 | Chinnery . | |
| 1,115,531 | 11/1914 | Hardinge | 241/175 |
| 2,551,984 | 5/1951 | Walton | 222/196 |
| 2,561,022 | 7/1951 | Liesch | 366/108 |
| 2,822,598 | 2/1958 | Chanlund et al. | 366/55 |
| 2,875,989 | 3/1959 | Toulmin, Jr. | 366/118 |
| 3,166,222 | 1/1965 | Schrader | 366/108 |
| 3,339,808 | 9/1967 | Sterns | 222/196 |
| 3,539,117 | 11/1970 | Sjogren | 241/175 |
| 3,592,448 | 7/1971 | Stevenson | 366/56 |
| 3,680,842 | 8/1972 | Sironi | 366/116 |
| 3,933,316 | 1/1976 | Jones | 241/175 |
| 3,933,341 | 1/1976 | Hudelmaier | 366/57 |
| 4,232,972 | 11/1980 | Levin | 366/108 |

FOREIGN PATENT DOCUMENTS 2729597 6/1977 Fed. Rep. of Germany .

*Primary Examiner*—Robert W. Jenkins
*Assistant Examiner*—Michael Knick
*Attorney, Agent, or Firm*—Christie, Parker & Hale

[57] ABSTRACT

The invention relates to a concrete mixer, in particular a free-fall mixer, in which the components of the concrete, in particular initially without water, can be intermixed by mixing elements by means of the rotation of a drum, wherein a vibrator is provided.

The object of the invention is to make the mixing process easier and to save energy. This object is attained in that a vibrator which is switched on during the mixing process in order to reinforce it is disposed in the drum in the vicinity of the material to be mixed.

7 Claims, 4 Drawing Figures

CONCRETE MIXER

DESCRIPTION

Figure 1:
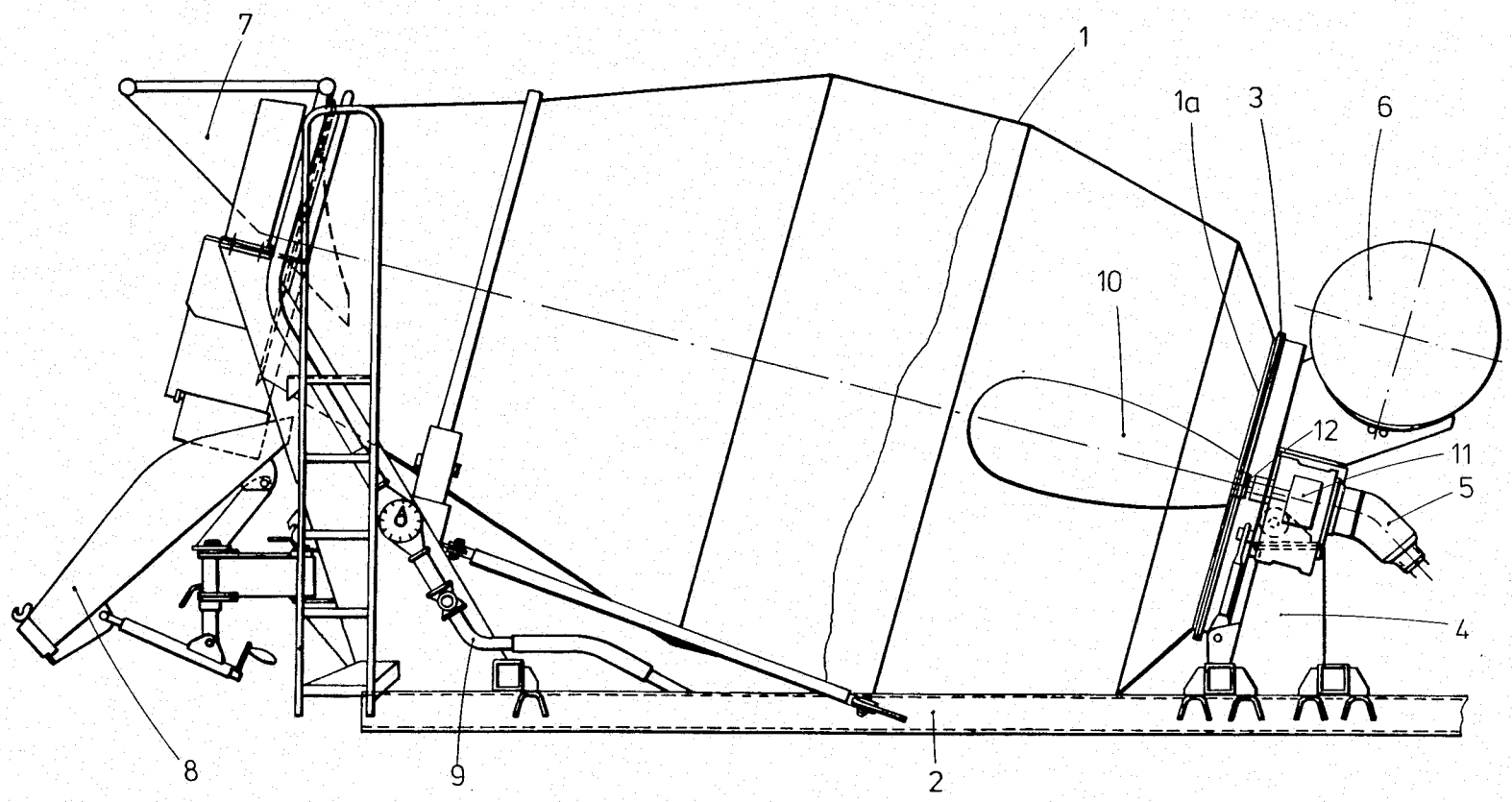

The invention relates to a concrete mixer as generally described by the preamble to claim 1.

A concrete mixer is known from German laid-open application No. 2 729 597 which has a filler tube especially embodied for cooperation with especially shaped supply containers for cement and additives. The filler tube has a ring surrounding its fill opening. In the filling position, this ring comes to rest on a carrier ring of the supply container, and elements are provided which upon contact of the rings open a covering over the container opening. In one form of embodiment, referred to only in words, a vibrator is disposed in the vicinity of the two rings contacting one another. The vibrator generates oscillations in the area in which the supply container and the filler tube of the drum rest on one another and thus makes it easier to empty the container or in other words to fill the drum. The vibrator has no influence on the mixing process in the drum, even if the drum is already rotating during the filling process or in other words is already beginning the mixing process.

It is the object of the invention to make easier the mixing process in the drum, which especially in the case where the concrete ingredients are still dry or are only partially dampened requires substantial energy because of their internal friction, so as to save energy and as needed to shorten the process as well.

The object is attained in accordance with the invention by means of the characteristic of claim 1.

The disposition according to the invention of the vibrator in the primary mixing zone is based upon the surprising discovery that because of the energy of vibration the internal friction of the material to be mixed is substantially reduced, and the mixing process can be intensified thereby. The action of the vibrator in the described manner, which saves time and energy, is particularly astonishing because vibrations are as a rule used for separation processes instead. A separation effect is avoided by the simultaneous rotation of the drum. The vibrations loosen up the material to be mixed and thereby make the mixing action of the rotational movement substantially more effective. At the same time, additional displacement work is applied to the ingredients of the concrete as a result of the energy of vibration, which intensifies the mixing process characterized by a continuous mutual displacement of the ingredients. The energy saving realized by using the vibrator is substantially produced because the vibrator requires a relatively small amount of energy to excite it in contrast to a drum drive mechanism and/or the drive mechanism of a supplementary mixing tool in the area of the drum bottom. In comparison with this latter arrangement, a vibrator disposed in the interior of the drum can be better sealed from the outside. A further advantage is that a reduction gear is not required for driving the vibrator; the rotatable part can be operated at high speed.

A further substantial advantage of the vibrator is in its adaptability to a particular composition of the material to be mixed, attained by simply regulating the frequency and amplitude of its oscillations. At low frequency and large amplitude, the vibrator performs a stirring action. High frequency and small amplitude produce oscillations which are in the characteristic or resonant frequency range of the material to be mixed or of one component of this material. A permanent variation over the entire amplitude band during the mixing process can, as needed, assure that the resonant frequency of the material to be mixed or of individual components of the material is in any case repeatedly attained, even if the resonant frequencies change during the course of the mixing process.

Depending on the shape, size and application of the concrete mixer, the vibrator can have different shapes and/or be variously disposed in the drum bottom. Such possibilities are disclosed in the dependent claims.

Figure 2:
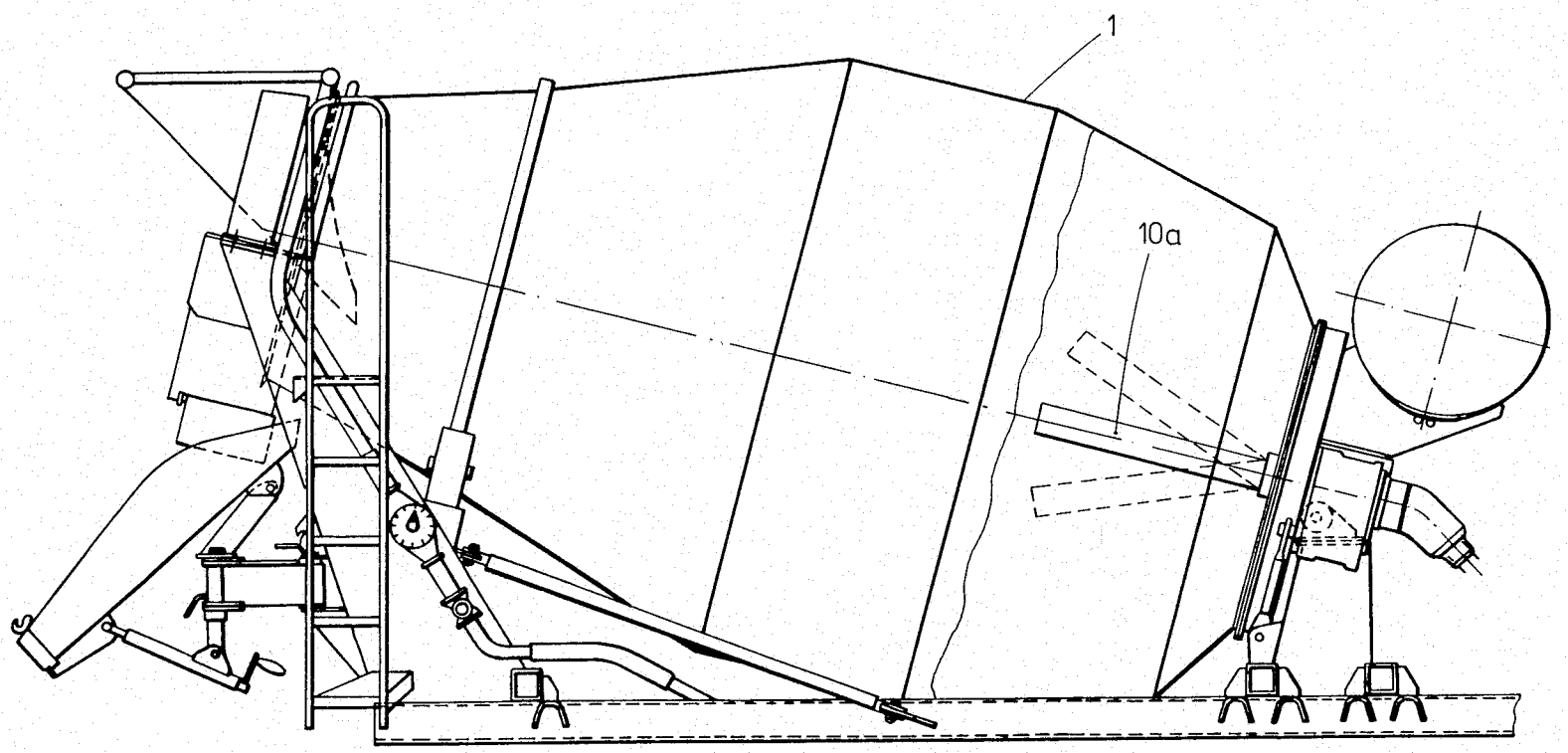
Figure 3:
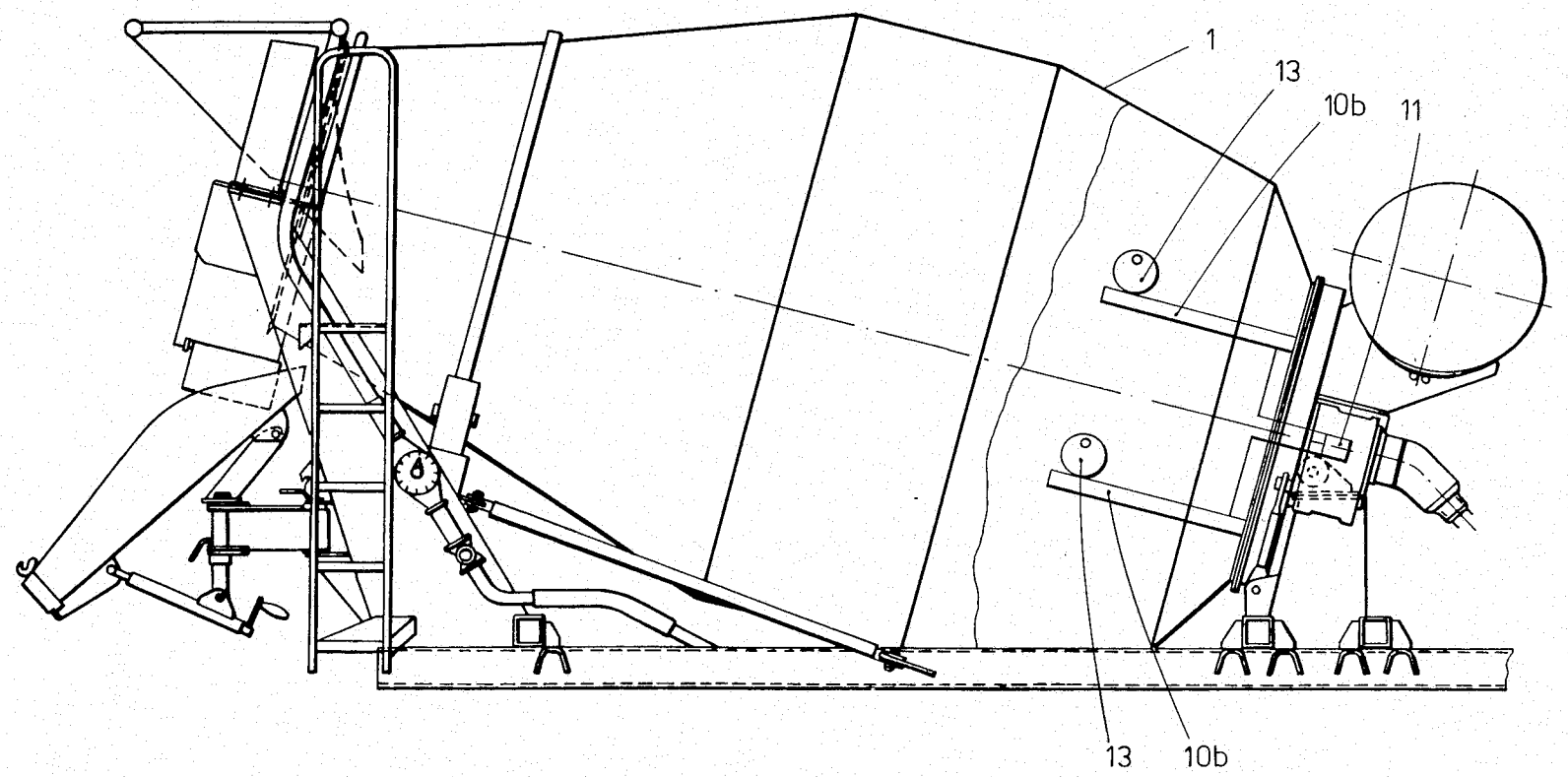

Various forms of embodiment of the invention are shown schematically in the drawings. Shown are:

FIG. 1, a concrete mixer with a partially cutaway drum and a vibrator in the shape of a bottle;

FIG. 2, a mixer having a vibrator in the shape of a swinging rod in several operating positions;

FIG. 3, the mixer having two swinging rods; and

Figure 4:
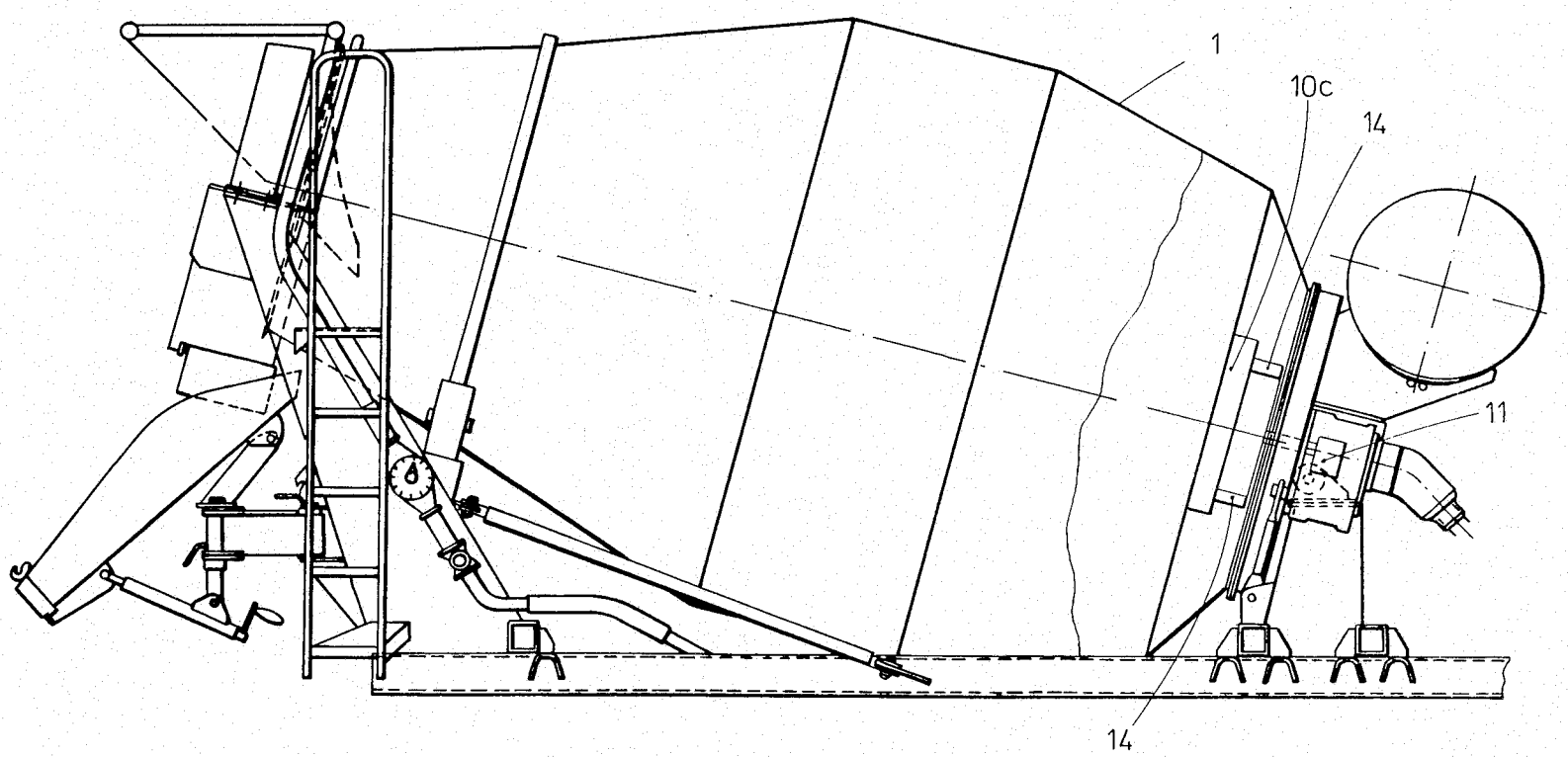

FIG. 4, the mixer having a vibrator in the shape of a plate.

The concrete mixer shown in FIG. 1 has a drum 1 which is supported on a carrier 2. The carrier may be part of a mixer vehicle or a stationary assembly. In the vicinity of the drum bottom 1*a*, the drum is supported on a ring mount 3, which is supported by means of a pedestal 4 on the carrier 2. The connecton to a rotary drive mechanism, not shown, is effected via the schematically drawn connector fitting 5. A water tank 6 is also disposed in the vicinity of this end of the drum. In the vicinity of the mouth of the drum, a filler tube 7, an outlet funnel 8 and a water supply line 9 are shown.

A vibrator generally indicated by reference numeral 10 protrudes into the interior of the drum centrally with respect to the drum bottom. The vibrator is in the shape of a bottle. It is connected with its schematically drawn drive unit 11 located outside the drum by way of a hydraulic revolving turret 12, also schematically drawn. The drive of the vibrator may be effected mechanically, hydraulically, pneumatically or electrically. The simplest means is a V-belt driven by a hydraulic motor.

During the mixing process in the rotating drum, the vibrator 10, which is in direct contact with the material being mixed, introduces oscillating energy into the material being mixed, which is predominantly located in the vicinity of the drum bottom. As a result of the vibration, the internal friction of the material being mixed is reduced to such an extent that the rotational movement exerts an intensive mixing effect on the material being mixed. The mixing process is thereby intensified and the mixing time shortened. The frequency and amplitude of the vibration can be adjustably set via control devices, not shown, in accordance with the composition of the material to be mixed, during the course of the mixing if needed. Appropriate frequencies are from approximately 1 Hz to 200 Hz.

FIG. 2 shows a vibrator 10*a* in the form of a swinging rod in the drum 1, both in the position of rest and in two opposite pivoted positions, the latter indicated by broken lines. The vibrator 10*a* pivots with a relatively large amplitude, as a result of which it also brings about a stirring effect in the material being mixed.

FIG. 3 shows two vibrators 10*b* in the drum 1, which are disposed symmetrically with respect to the center of the drum and are drivable in common. Each vibrator 10*b* carries an eccentric body 13.

FIG. 4 shows a form of embodiment of a vibrator 10*c* in the shape of a plate, extending parallel to the drum bottom and centrally with respect to the drum axis, and the supports 14 of the plate are connected with the drive unit 11.

The various vibrator shapes shown are only a selection from among further possibilities. It is also possible for one or more vibrator bodies to be disposed eccentrically with respect to the drum axis. The symmetrical disposition of more than one vibrator body in the vicinity of the drum wall is also possible within the scope of the invention. The selection from among these possibilities should be made in accordance with the size of the drum and the properties of the material to be mixed. What is decisive is that the vibrational energy be introduced into the material to be mixed with the greatest possible effective range.

In a drum embodied as a compulsory mixer, with mixing tools in the interior, the vibrator may be disposed on a mixing tool.

What is claimed is:

1. A concrete mixer comprising:

a drum rotatable about an inclined axis, the drum having at one end a closed bottom disposed about the axis and at the other end an open top disposed about the axis;

a vibrator located in the drum at the bottom thereof;

a drive unit for the vibrator located outside the drum in the vicinity of the bottom thereof; and means for coupling the drive unit to the vibrator through the bottom of the drum, thereby introducing vibrational energy into material to be mixed at the bottom of the drum.

2. The concrete mixer of claim 1, in which the vibrator, the couplng means, and the drive unit are all aligned with the axis.

3. The concrete mixer of claim 2, in which the vibrator comprises a bottle-shaped element.

4. The concrete mixer of claim 2, in which the vibrator comprises a rod-shaped element that vibrates by pivoting about one end.

5. The concrete mixer of claim 1, in which the vibrator comprises a pair of elongated elements each carrying an eccentric body.

6. The concrete mixer of claim 1, in which the vibrator comprises a plate extending parallel to the bottom of the drum.

7. The concrete mixer of claim 1, in which the drive unit excites the vibrator at a frequency between 1 Hz and 200 Hz.

* * * * *